US005950744A

United States Patent [19]

Hughes

[11] Patent Number: 5,950,744

[45] Date of Patent: Sep. 14, 1999

[54] METHOD AND APPARATUS FOR ALIGNING DRILL PIPE AND TUBING

[76] Inventor: W. James Hughes, 6231 E. 100th Pl., Tulsa, Okla. 74137

[21] Appl. No.: 08/950,047

[22] Filed: Oct. 14, 1997

[51] Int. Cl.[6] ..... E21B 17/046

[52] U.S. Cl. ..... 175/320; 166/242.6; 285/330; 285/913; 285/914; 403/364

[58] Field of Search ..... 403/22, 343, 364, 403/264; 285/330, 913, 914; 175/320; 166/242.6

[56] References Cited

U.S. PATENT DOCUMENTS

| | | | |
|---|---|---|---|
| 1,438,751 | 12/1922 | Isles | 220/3.3 |
| 1,547,759 | 7/1925 | Journeay | 285/85 |
| 3,287,031 | 11/1966 | Simmons et al. | 285/27 |

FOREIGN PATENT DOCUMENTS

| | | | |
|---|---|---|---|
| 933739 | 9/1963 | United Kingdom | 175/320 |

*Primary Examiner*—David Bagnell
*Assistant Examiner*—John Kreck
*Attorney, Agent, or Firm*—William S. Dorman

[57] ABSTRACT

A pipe joint for self aligning a drill string, tubing string or casing string of the type comprising a plurality of drill pipe, tubing or casing sections arranged in end to end relation from a location above the ground to a lower location adjacent a tool connected to a bottom end of the string and wherein the adjacent ends of the sections are connected to each other to form a plurality of spaced joints extending downwardly from the ground to the tool, the improvement wherein each joint comprises an upper section having at least one downwardly projecting extension and a lower section having a corresponding recess for receiving the extension and wherein the extension and the recess can fit together in only one way.

11 Claims, 9 Drawing Sheets

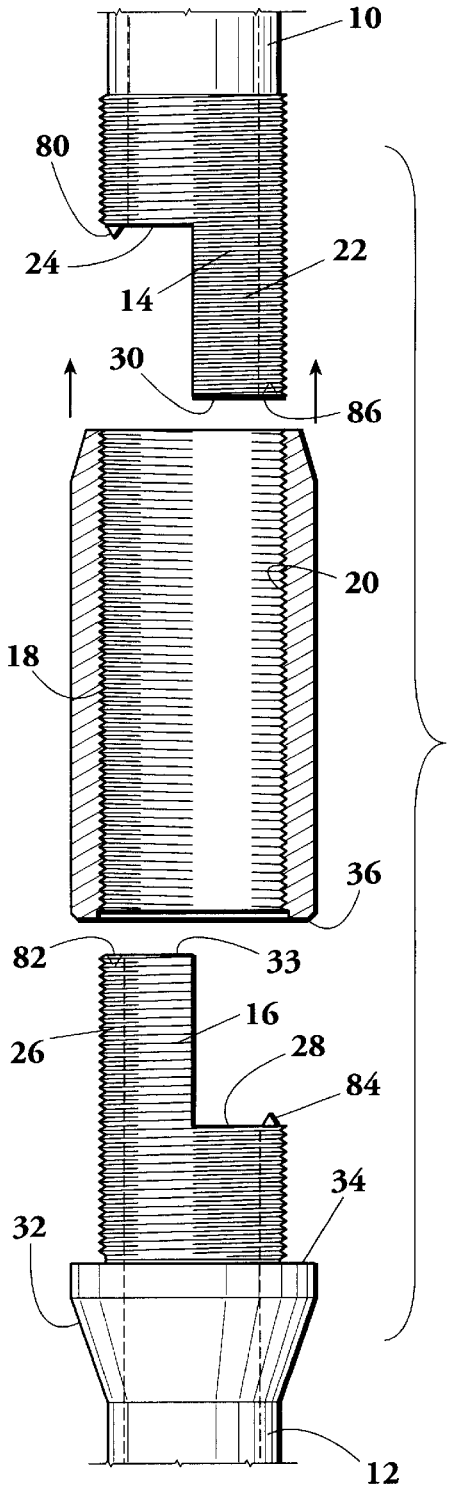
Fig. 9
Fig. 11
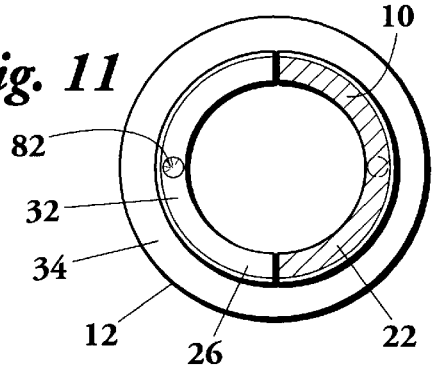
Fig. 10
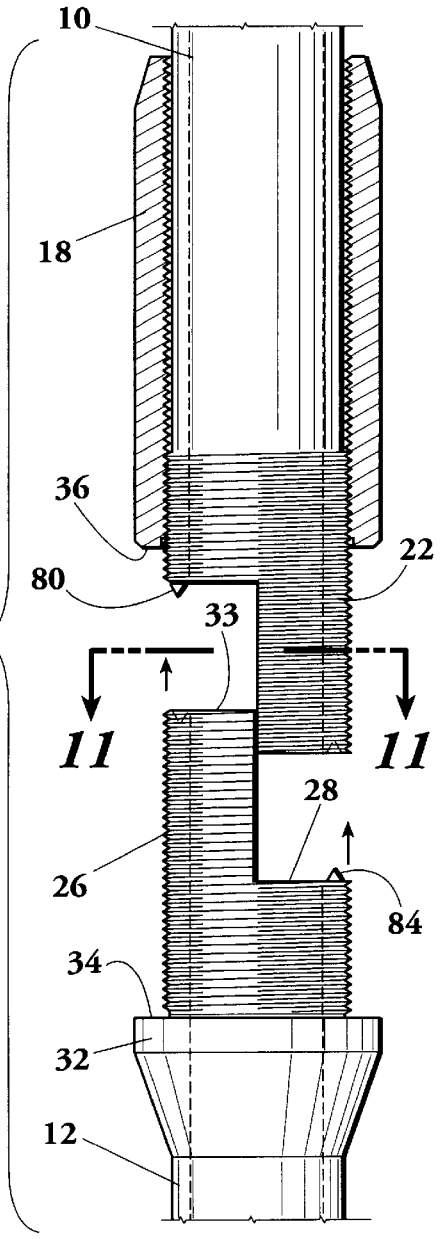

METHOD AND APPARATUS FOR ALIGNING DRILL PIPE AND TUBING

BACKGROUND OF THE INVENTION

1. Field of the Invention

The present invention relates to a method and apparatus for aligning drill pipe or tubing utilizing novel tool joints or end connections. The present invention involves a method and apparatus for assuring that adjacent sections of drill pipe or tubing mate with each other the same way each time that they are put together.

2. The Prior Art

One of the problems in directional drilling is determining what direction the drilling device is pointing at the bottom of the well. Is it pointing North, East, South or West? Of course, if you could put the drill string sections together the same way each time such that they were tightened precisely the same amount, then one would expect that the directional drilling device at the bottom would be oriented in the same direction every time. However, it is not possible to tighten drill string sections precisely the same amount.

The same considerations hold true for tubing (as opposed to drill pipe) in that it sometimes becomes desirable to know in what direction a certain section of the tubing is oriented; for example, in the case of tubing conveyed perforating guns which are to make holes in casing. It may be desirable to know the direction in which the perforating gun is oriented prior to the commencement of the perforation operation. The present invention has a unique application to the use of any downhole tool which is attached to either a drill pipe section or a tubing section where the orientation of this downhole tool is important for the purpose of the operation in which the downhole tool is involved.

A preliminary search was conducted on the present invention and the following listed patents represent the results of the search:

| U.S. Pat. No. | Inventor | Issue Date |
|---|---|---|
| 745,842 | Hock, et al. | 12-01-03 |
| 1,547,759 | Journeay | 07-28-25 |
| 1,780,712 | Little | 11-04-30 |
| 2,490,316 | Ostrak | 12-06-49 |
| 4,821,818 | Mefferd | 04-18-89 |

Hock U.S. Pat. No. 745,842 shows a drill pipe wherein a shoulder 5 is provided with a sleeve 3 surrounding the adjacent pipe sections between the shoulders.

Journeay U.S. Pat. No. 1,547,759 shows a tool joint where adjacent pipe sections are provided with interlocking tongues 14 and grooves 13. However, in the Journeay patent there are four tongues and four grooves, all symmetrically arranged; therefore, it would be possible to place the adjacent pipe sections in four different relative angular relationships.

Little U.S. Pat. 1,780,713 is a flexible coupling for electrical fixtures and has nothing to do with drill pipe or the like.

Ostrak U.S. Pat. No. 2,490,316 is also an electrical connector. This patent shows adjacent electrical cables intermating with angled members. However, this patent has nothing whatever to do with drill pipe.

Mefferd U.S. Pat. No. 4,821,818 relates to an auger for drilling holes in the ground. This patent is similar to the Joumeay patent discussed above. In FIG. 3 of Mefferd, the mating ends of two sections is shown as each having six projections 40 and six indentations 42. These projections and indentations are all symmetrical so that it would be possible to obtain six different relative angular positions of one section with an adjacent mating section.

SUMMARY OF THE INVENTION

Two adjacent drill pipe sections are constructed in such a manner that their mating portions can be combined in only one way. For example, in one embodiment of the invention an upper drill pipe section is provided with a semi-annular extension which extends downwardly and mates with a semi-annular recess on a lower and adjacent pipe section. The extension and the recess combine to form the full annulus of a drill pipe. These two mating sections are threaded and a collar is screwed over the intermating sections to provide a complete pipe joint. In another embodiment of the invention, the semi-annular extension on the upper drill pipe section is provided with an inclined shoulder which mates with an oppositely inclined shoulder on the recess of the adjacent lower drill pipe section. In a still further embodiment of the present invention, the intermating portions of the upper drill pipe section are provided with conical pins which mate with conical recesses on the upper end of the lower drill pipe section. In a still further embodiment of the invention, the upper drill pipe section is provided with three asymmetrically arranged projecting legs which mate with three asymmetrically arranged and correspondingly located recesses on the upper end of the lower drill pipe section such that the two drill pipe sections can come together in only one way. In another embodiment of the present invention, the upper drill pipe section is provided with seven downwardly projecting and asymmetrically arranged legs which mate with seven asymmetrically arranged recesses on the lower drill pipe section. In a still further embodiment of the present invention, the upper and lower drill pipe sections are provided with key slots and one of the drill pipe sections has keys welded in the slots so as to mate with the key slots on the other drill pipe section.

BRIEF DESCRIPTION OF THE DRAWINGS

FIG. 9 is a view similar to FIG. 1 but showing a still further embodiment of the intermating relationship between adjacent sections of drill pipe.

FIG. 10 is a view similar to FIG. 2 but showing the embodiment of FIG. 9.

FIG. 11 is a sectional view taken along section line 11—11 of FIG. 10.

DETAILED DESCRIPTION OF THE PREFERRED EMBODIMENTS

Figure 1:
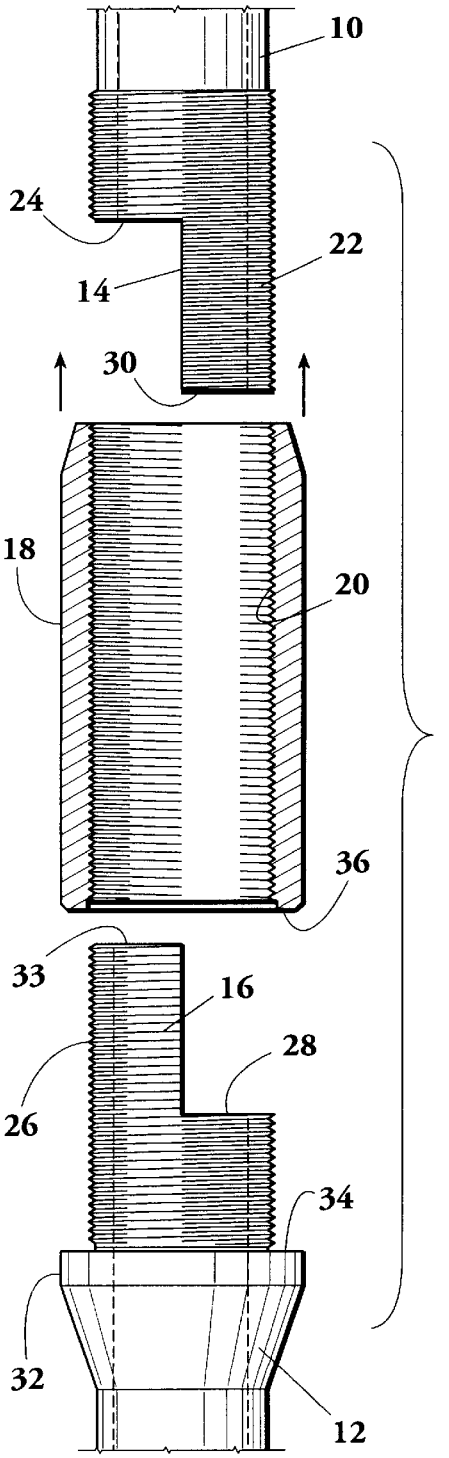
FIG. 1 is an exploded elevational view, with the collar being in section, showing two adjacent drill pipe sections constructed in accordance with one embodiment of the present invention.

Referring to the drawings in detail, FIGS. 1, 2, 3 and 4 show a portion of a drill string which includes an upper section 10 of drill pipe cooperating with a lower section 12 of drill pipe. The drill pipe sections are hollow and the metallic portions thereof, in cross-section, form an annulus. The lower end 14 of the upper section 10 mates with an upper end 16 of the lower section 12. The lower end of the upper section 10 and the upper end of the lower section 12 are both threaded as shown and a collar 18 is provided having internal threads 20 which will mate with the threads of ends 14 and 16. As best shown in FIG. 1, the upper section 10 is provided with a downwardly projecting leg 22 which represents a downward projection of one half of the diameter of the lower end 14. The upper end of the half section 22 terminates at a shoulder 24 which extends across the remainder of the lower end 14.

Similarly, the upper end 16 of the lower drill pipe section 12 is provided with an upwardly extending portion 26 which represents an upward extension of one half of the portion 16, more particularly the left-hand half. The semicircular extension 26 terminates at a shoulder 28 which extends across the remainder of the upper end 16. When, as it will hereinafter appear, the upper drill pipe section 10 is lowered into contact with the lower drill pipe section 12, a lower end 30 of the extension 22 will rest against the shoulder 28 on the threaded end 16. At the same time, an upper end 33 of the extension 26 will rest against the shoulder 24 of the threaded end 14.

Figure 2:
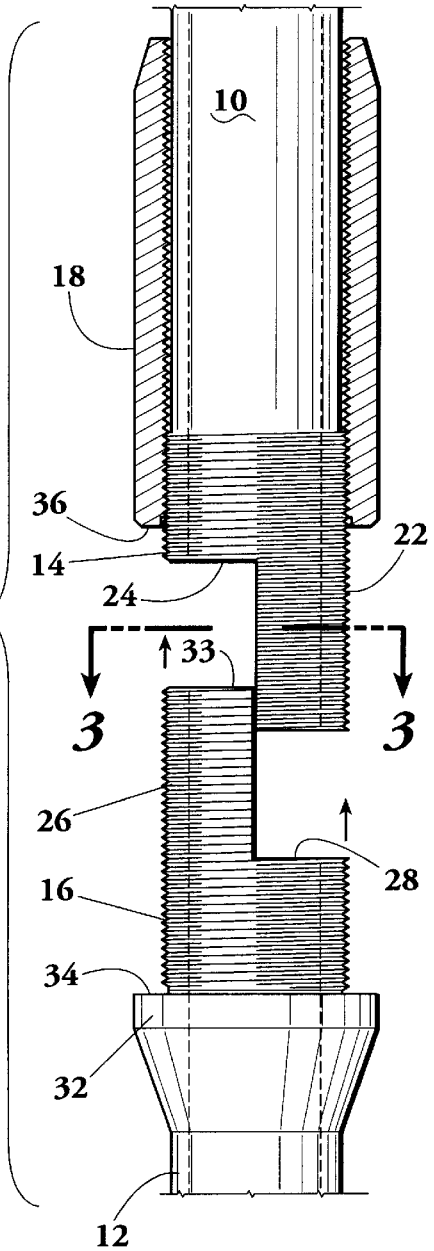
FIG. 2 is a view similar to FIG. 1, but showing the upper section lowered down towards and into initial engagement with the lower section and the threaded collar starting to thread down from the upper section to the lower section.

FIG. 2 represents the progression of the connection of the pipe section 10 to the pipe section 12. The vertical side edges of the extension 22 of the drill pipe 10 will contact the vertical edges of the extension 26 of the upper portion 16 of the drill pipe section 12. It will appear that the upper end 33 of the extension 26 is now approaching the shoulder 24 of the end 14 while the end 30 of the extension 22 is approaching the shoulder 28 of the end 16. The collar is located on the lower end 14 of the drill pipe section 10 above the shoulder 24.

Figure 4:
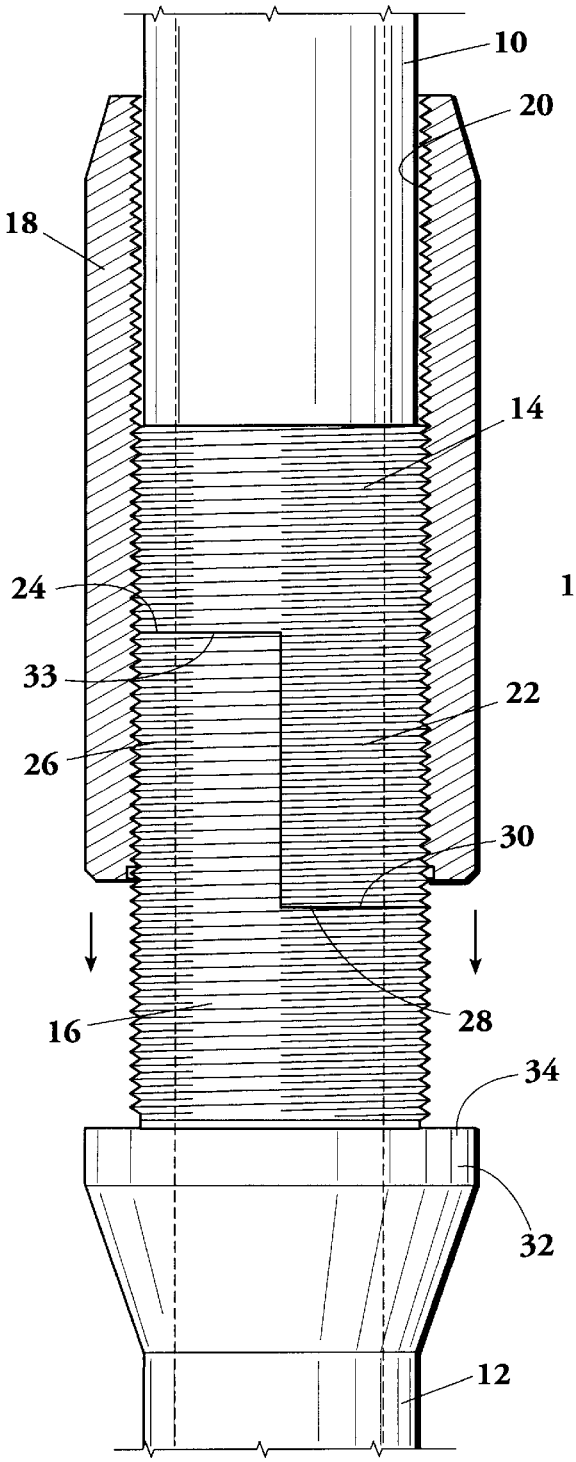
FIG. 4 is a view similar to FIG. 3 but showing the upper section actually mating with the lower section, and with the threaded collar being advanced into initial engagement with the lower section.
Figure 5:
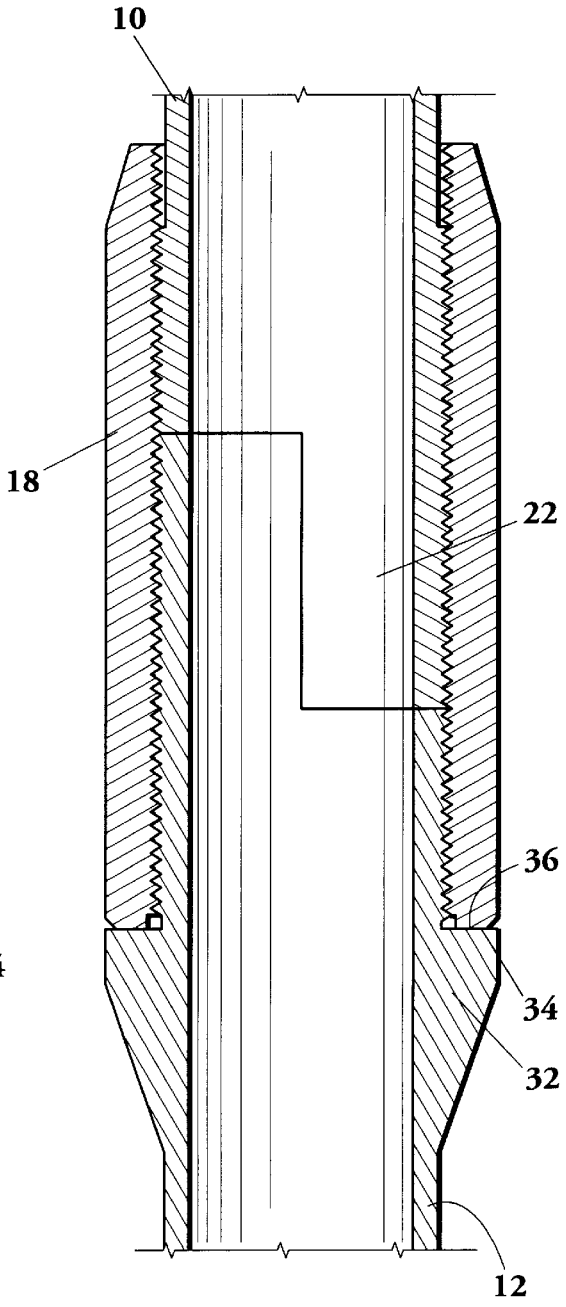
FIG. 5 is a view similar to FIG. 4 but showing the adjacent drill pipe sections in section and with the threaded collar being threaded all the way onto and into engagement with a shoulder on the lower drill pipe section to form what is commonly referred to as a "tool joint".

The lower drill pipe section 12 is provided with a flange 32 and an upset or shoulder 34 below the lower end of the threaded section 16. A lower end 36 on the threaded collar 18 will bear against the shoulder 34 when the sections 10 and 12 are fully nested and the collar screwed down completely as shown in FIG. 5. Turning now to FIGS. 4 and 5, FIG. 4 represents a condition where the lower end of the drill pipe 10 is fully engaged with the lower drill pipe 12 with the half sections 22 and 26 mating with each other so that the upper end 33 of the extension 26 is resting against the shoulder 24 of the lower end 14 while, at the same time, the end 30 of the semicircular extension 22 is resting against the shoulder 28 of the upper end 16. The collar 18, however, is still not fully threaded onto the upper end of the lower drill pipe 12; i.e., the end 36 of the collar 18 is still spaced above the shoulder 34 on the flange 32. FIG. 5 represents the complete intermating of the drill pipe sections 10 and 12 with the collar 18 fully tightened on the threaded portions of the drill pipe sections to form a complete tool joint such that the lower end 36 of the collar 18 is now bearing against the shoulder 34 on the flange 32.

Figure 3:
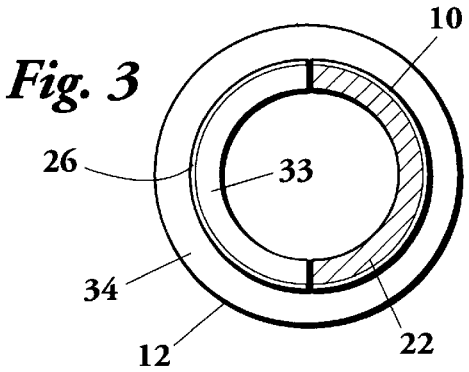
FIG. 3 is a sectional view taken along section line 3—3 of FIG. 2.

As best shown in FIG. 3 the portions of the two drill pipe sections 10 and 12 which mate with each other are semicircular extensions 22 and 26. The upper surface 33 of the portion 26 is shown in FIG. 3 because of the location of the section line 3—3. However, it should be abundantly clear that we have two semicircular or semi-annular portions 22 and 26 which mate with each other and which together, as represented by the FIGS. 4 and 5 positions, form a complete through passage as would be accomplished by the interconnection of any two drill pipe sections. On the other hand, drill pipe section 10 can connect with drill pipe section 12 in only one way, and that is when the extension 22 is turned or oriented in such an angular position that it will be received in the cut out area of the lower drill pipe section 16 as represented by the extension 26 and the shoulder 28. Therefore, if there were a hundred or more sections of drill pipe where the adjacent ends were provided with extensions 22 and 26 and shoulders 24 and 28 the drill pipe would be in perfect alignment from the uppermost drill pipe section to the lowermost section for the simple reason that each drill pipe section can mate with the next lower drill pipe section in only one way.

The upper drill pipe section 10 described in FIGS. 1 to 5, inclusive, is shown as having a certain shape configured at the bottom thereof while the lower drill pipe section 12 is shown as having a certain shape configured at the top thereof which is complementary to the shape at the bottom of the drill pipe section 10. It should be understood, however, that the top (not shown) of drill pipe section 10 would be configured in the same way as the top of drill pipe section 12 and that the bottom (not shown) of drill pipe section 12 would also be configured in the same way as the lower portion of drill pipe section 10. In order for this invention to work properly, one might machine drill pipe section 10, for example, so that the portions at the top end (not shown) of drill pipe section 10 would be in alignment with the configuration shown at the bottom of drill pipe section 10 (as it appears in FIG. 1). It is recognized that drill pipe sections such as section 10 or section 12 are generally 30 to 40 feet in length. Therefore, it would be necessary, when machining the ends of drill pipe section 10, for example, that the lathe or other instrument upon which the drill pipe section 10 is mounted is controlled in such a manner that the end portions are in alignment with each other during the machining process. The same considerations hold true for drill pipe sections 12 or any other drill pipe section which is machined in accordance with the illustrations of FIGS. 1 and 2, as well as any other embodiments shown hereinafter. However, since drill pipe sections are generally 30' in length or more and since the threaded end 14 has threads thereon which project beyond the outer diameter of the drill pipe section 10 above the threaded portion 14 (as shown in FIG. 1), it is not easy or even feasible to machine a total drill pipe section so as to provide shapes and threads at the opposite ends. In fact, it is common practice in the industry to take a separate drill pipe tube and attach the "joint" ends to the ends of the drill pipe tube by welding, for example, as will be explained in greater detail hereinafter.

Figure 6:
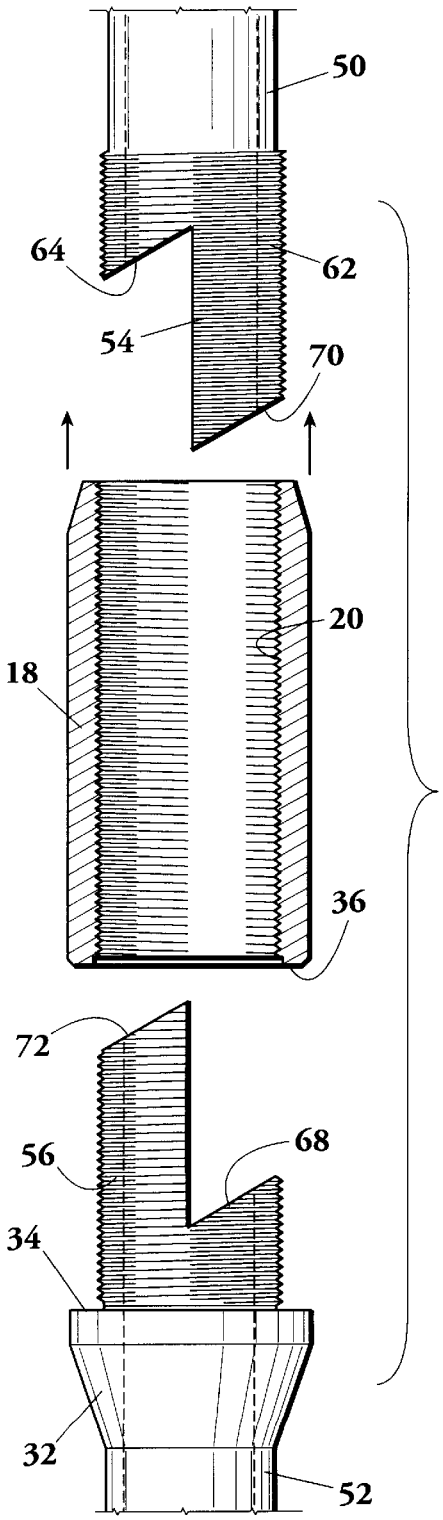
FIG. 6 is a view similar to FIG. 1 but showing a modified form of intermating drill pipe sections.
Figure 8:
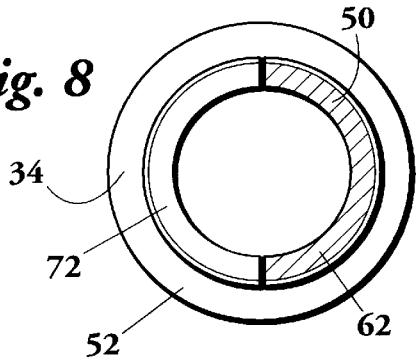
FIG. 8 is a sectional view taken along section line 8—8 of FIG. 7.
Figure 7:
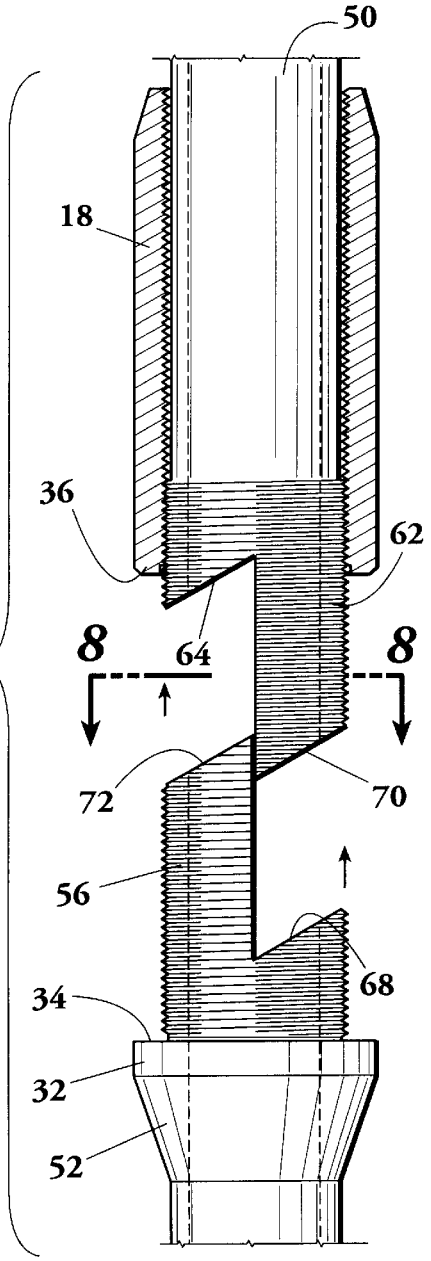
FIG. 7 is a view similar to FIG. 2 but showing the embodiment of FIG. 6.

Turning again to FIG. 3, if lateral forces were imposed at the upper end (not shown) of the drill string; i.e., at the derrick, it would be possible for the portion 22 to swing to the right so that the vertical edges of the section 22 were no longer contacting the vertical edges of the portions 26. The lateral forces, referred to above, could still cause the section 22 to move away from the section 26 even if the drill pipe 10 were lowered into engagement with the drill pipe 12 so that the end 30 was against the shoulder 28 and the end 33 was against the shoulder 24, assuming that the threaded collar 18 was still above the shoulder 24. The purpose of the configurations shown in FIGS. 6, 7 and 8 is to prevent the lateral forces from causing separation of the intermating portions of the drill pipe sections 10 and 12 before the collar 18 is secured in place. Thus, FIG. 6 shows a portion of a drill string which includes drill pipe section 50 and lower drill pipe section 52. The upper drill pipe would have a threaded portion 54 whereas the lower drill pipe would have a threaded portion 56. The collar 18 would be essentially the same. However, for the purposes of avoiding the lateral swinging referred to above, a portion 62 of the threaded portion 54 which extends downwardly is provided with a lower edge 70 which is inclined and which is adapted to mate with an inclined shoulder 68 on the threaded portion 56. Likewise, the threaded portion 56 is provided with an upper inclined end 72 which is adapted to mate with an inclined shoulder 64 on the threaded portion 54. Stated somewhat differently, the inclined ends or shoulders 64, 68, 70, and 72 are all parallel to a plane which is inclined with respect to the longitudinal central axis of the resulting drill pipe shown in FIG. 6. The lower drill pipe 52 is provided with a flange 32 and a shoulder 34 and the lower end of the threaded collar 18 is provided with a flat end 36, as previously described. If the drill pipe 50 with the collar shown in the position in FIG. 7 were subject to lateral stresses, as described above, the extension 62 of the upper drill pipe 50 could still swing away from the semi-annular portion 56 of the lower drill pipe 52. However, if the drill pipe 50 of FIG. 7 were lowered towards the drill pipe 52 with the threaded collar 18 being in the same position as shown until the inclined end 70 came in contact with the inclined shoulder 68 while the upper inclined end of the section 56 came in contact with the inclined shoulder 64, then the lateral forces referred to above which might be exerted at the top of the drill string and which would proceed progressively downward to exert the same forces on succeeding sections of drill pipe would still tend to exert a lateral force on the drill pipe section 50; however, the extension 62 would not be subject to movement away from the section 56 because of the notched engagement of the ends 70 and 72 with the shoulders 64 and 68. Thus, the configuration shown in FIGS. 6, 7 and 8 provides a certain amount of protection to prevent lateral separation of the tool joint after the extensions are nested and while the collar is being lowered from the position shown in FIG. 7 until the lower end 36 thereof comes in contact with the shoulder 34.

The embodiment shown in FIGS. 9, 10 and 11 is almost the same as the embodiment shown in FIGS. 1, 2 and 3, but the embodiment of FIGS. 9, 10 and 11 is provided with the same type of protection described in connection with FIGS. 6, 7 and 8; i.e., the protection that prevents the outward swinging of the interconnecting portion of the upper drill pipe away from the corresponding portion of the lower drill pipe. More particularly, FIG. 9 shows an upper drill pipe 10, a lower drill pipe 12, a lower threaded portion 14 on the drill pipe 10 and an upper threaded portion 16 on the drill pipe 12, all as described in relation to FIG. 1. Furthermore, a threaded collar 18 is provided having internal threads 20. The threaded portion 14 of the upper drill pipe 10 is still provided with a downwardly extending semi-annular extension 22 and a shoulder 24 which defines the annular extension in relation to the remainder of the threaded portion 14. Similarly, the threaded portion 16 of the drill pipe 12 is provided with a semi-annular extension 26 which extends upwardly from the remainder of the threaded portion 16 and which defines the shoulder 28, all as described in connection with FIG. 1. In order to provide a means for preventing the undesirable effect of the lateral forces imposed upon the drill string, the shoulder 24 is provided with a downwardly projecting conical pin 80 which is adapted to mate with a conical recess 82 on the upper end 33 of the annular projection or extension 26. Similarly, the shoulder 28 on the lower drill pipe 12 is provided with an upwardly projecting conical pin 84 which is adapted to mate with a conical recess 86 on the lower end 30 of the semi-annular extension 22. The elements shown in FIG. 10 function in substantially the same way as the elements shown in FIG. 7, as previously described. Referring to the elements shown in FIG. 10 more particularly, if the lateral forces were exerted on the drill string as previously described, there would be nothing to prevent the extension 22 from moving away from the extension 26 as shown. However, if the drill pipe 10 were lowered down against the drill pipe 12 with the collar 18 being in the same position as shown in FIG. 10 but with the conical pins 80 and 84 mating with their respective conical recesses 82 and 84, if a lateral force were now exerted against the side of the drill pipe 10, the pin and recess connections would prevent separation between the annular extensions 22 and 26. Of course, when the collar 18 was threaded downwardly onto the lower threaded section 16 of the drill pipe 12 until the lower end 36 of the collar 18 were to engage the shoulder 34 of the flange 32, then there would be no way in which the extension 22 could move away from the extension 26.

In FIGS. 1 through 11, inclusive, the various embodiments of the invention disclosed and described therein are symmetrical with respect to the vertical. This is so because each drill pipe has a semi-annular section which mates with a semi-annular section on the adjoining drill pipe. That is, with respect to FIGS. 1 and 2, the extension 22 on the drill pipe 10 is precisely a semi-annular portion and the corresponding extension 26 on the lower drill pipe is precisely a semi-annular portion which mates with the extension 22. With respect to FIG. 3, the annular extension 22 extends for 180° of the circle which defines the combination of both extensions. Likewise, the extension 26 which is on the lower pipe comprehends precisely 180°. On the other hand, it is conceivable that the extension 22, for example, could extend for somewhat more than 180° of the combined circle shown in FIG. 3, in which case the extension 26 would have to be reduced from a semi-annular section by a corresponding amount. In such a case it would still be impossible to align adjacent sections other than one way because the two mating portions which would be the equivalent of extensions 22 and 26 would still together make up the whole circle as shown by the central circle on FIG. 3.

The embodiment shown in FIGS. 12 through 20 illustrate configurations which are not symmetrical with respect to the vertical axis, although there may be some degree of symmetry with respect to a horizontal plane.

Figure 12:
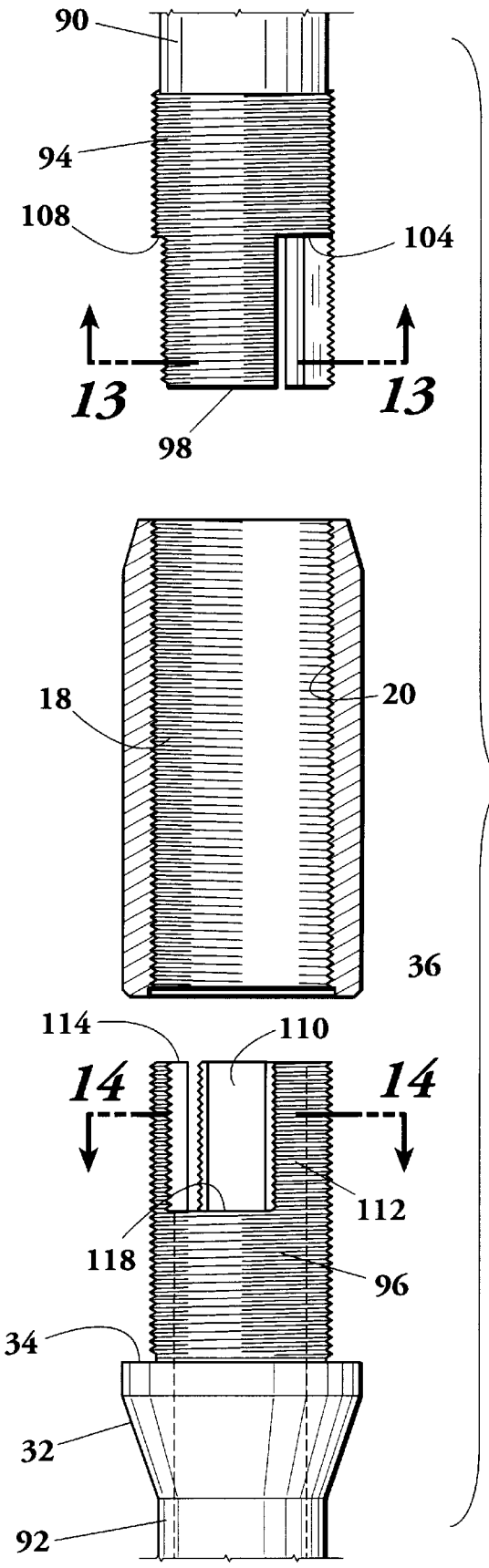
FIG. 12 is a view similar to FIG. 1 but showing a still further embodiment of the present invention.
Figure 13:
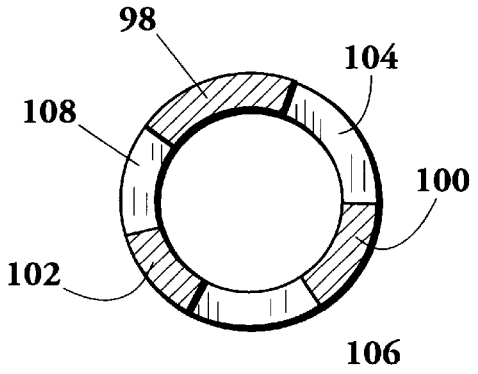
FIG. 13 is a sectional view taken along section line 13—13 of FIG. 12.
Figure 14:
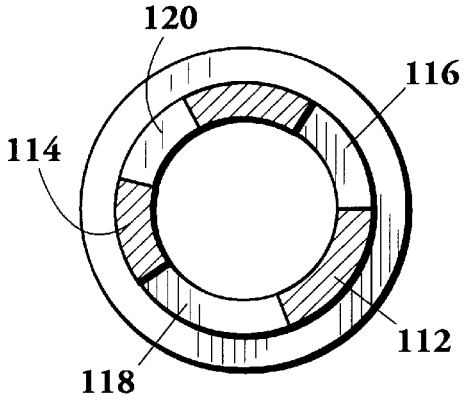
FIG. 14 is a sectional view taken along section line 14—14 of FIG. 12.

Referring now to FIGS. 12, 13 and 14, these figures show an upper drill pipe section 90 and a lower drill pipe section 92. The drill pipe 90 has a lower threaded end 94 while the drill pipe 92 has an upper threaded end 96. These two pipe sections, ultimately, will be connected together by means of a drill collar 18 having internal threads 20 which mate with the threads on the threaded ends 94 and 96. With respect to the upper drill pipe section 90, the threaded portion 94 thereof is provided with three downwardly projecting extensions or legs 98, 100 and 102 separated by three vertical recesses or slots 104, 106 and 108. In like fashion, the lower drill pipe section 92 has a threaded section 96 which provides three upwardly extending vertical extensions or legs 110, 112 and 114 separated by three vertical recesses or slots 116, 118 and 120 as best shown in FIG. 14. It should be noted that the legs 98, 100 and 102 are not symmetrically arranged with respect to the annulus represented by the threaded end 94, nor do they extend angularly to the same extent. The same can be said with respect to the recesses or slots 104, 106 and 108. When the upper drill pipe section 90 is lowered into engagement with the lower drill pipe section 92 the vertical legs 98, 100 and 102 will be received in the vertical slots or recesses 118, 116 and 120, respectively, on the threaded portion 96. At the same time, the extensions or legs 110, 112 and 114 on the threaded portion 96 will be received in the slots 106, 104 and 108, respectively, on the upper threaded portion 94 of the upper pipe section 90.

Purely for purposes of discussion, the vertical leg 98 on the upper pipe section 90 will be considered as extending annularly approximately 75° around the circumference of the circle shown in FIG. 13. Leg 100 will extend for approximately 60° while leg 102 will extend for approximately 45°. With respect to the vertical slots or recesses, the slot 104 will extend for approximately 70°, the slot 106 approximately 60°, and the slot 108 approximately 50°. Similar considerations hold true for the slots and extensions or legs shown in FIG. 14. For example, the slot 118 will extend for approximately 75° around the circle shown in FIG. 14 so as to correspond with the 75° annular relation of the vertical leg 98 which fits into the slot 118. For the sake of completeness, the vertical leg or extension 110 and the vertical slot 116 each extend approximately 60° around the circle shown in FIG. 14, whereas the vertical leg 112 extends for 70°. The slot 118 comprehends an arc of about 75°; the vertical leg 114 has an angular extent of about 50° and the remaining vertical slot 120 has angular extent of about 45°.

Referring again to FIGS. 12, 13 and 14, it should be obvious in light of the above discussion that it is possible to put the two sections 90 and 92 together in only one way because of the lack of symmetry in the arrangement of the respective legs or extensions and the vertical slots into which they fit considered also in light of the fact that the legs and slots vary from each other in the circumferential width which each represents with respect to the total annulus which they comprehend. Whereas the embodiment in FIGS. 12, 13 and 14 show three downwardly extending legs and three upwardly extending legs mating with slots between the various legs, it should be obvious that four or five legs, or more, could be provided on each end of each drill pipe so as to mate with a corresponding number of slots on the other drill pipe section.

The vertical legs 98, 100 and 102 shown in FIGS. 12 and 13 are illustrated as having vertical sides and the corresponding recesses of 118, 120 and 116 are also shown as having vertical side edges. However, it should be understood that the sides of the legs 98, 100 and 102 could be inclined such that the legs themselves would be triangular or pointed; correspondingly, the recesses 118, 120 and 116 would, under these circumstances, be V-shaped so as to fit with the triangular or pointed legs. Also, the bottoms of the legs could be curved, in which case the bottoms of the recesses would also be curved to accommodate the shape of the legs.

Figure 15:
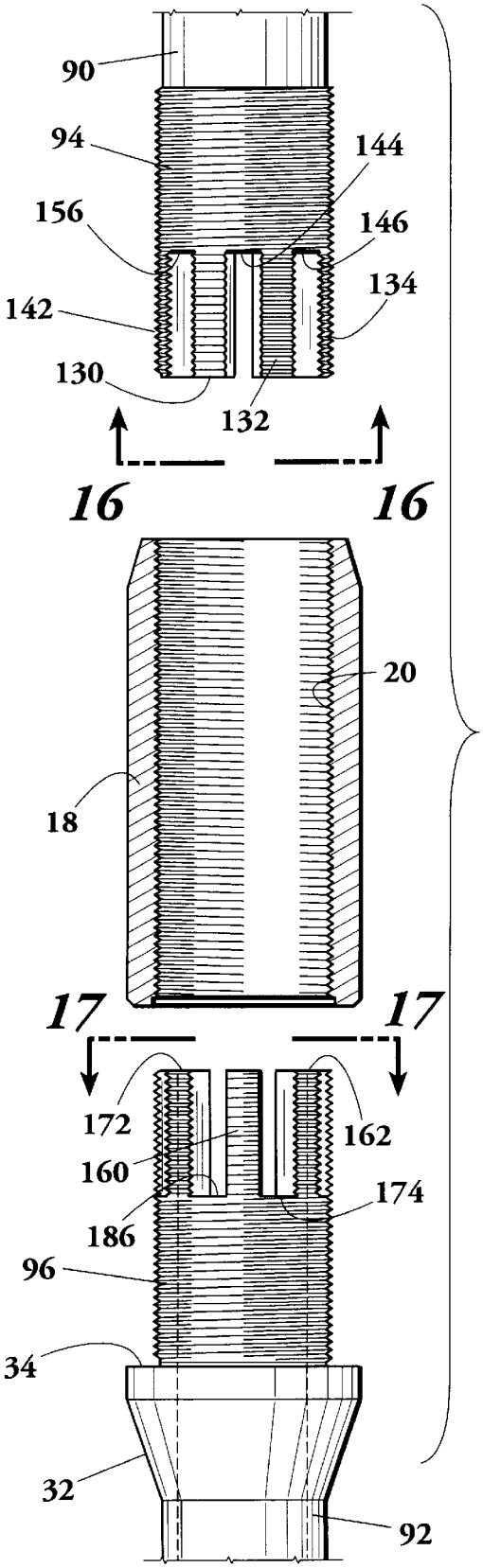
FIG. 15 is a view similar to FIG. 1 but showing a still further embodiment of the present invention.
Figure 16:
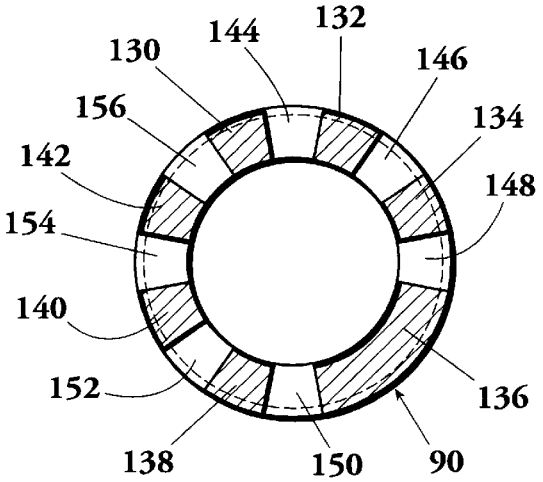
FIG. 16 is a sectional view taken along section line 16—16 of FIG. 15.
Figure 17:
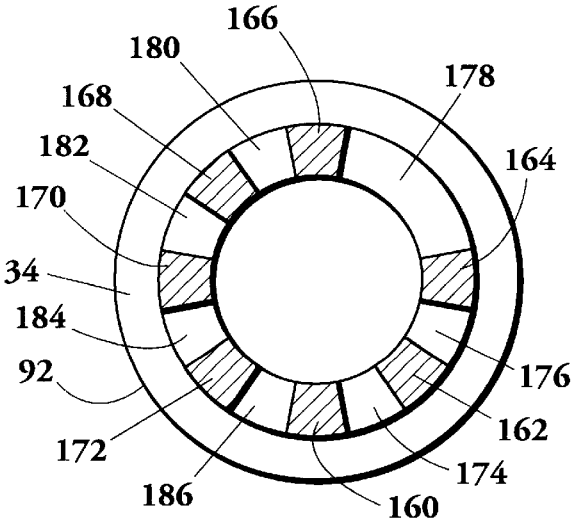
FIG. 17 is a sectional view taken along section line 17—17 of FIG. 15.

FIGS. 15, 16 and 17 are broadly similar to the arrangement shown in FIGS. 12, 13 and 14. However, the embodiment shown in FIGS. 15 to 17 includes seven downwardly projecting legs or extensions on the upper drill pipe with seven upwardly projecting legs or extensions on the lower drill pipe section which mate with corresponding slots or recesses between the various extensions. More particularly, FIG. 15 shows an upper drill pipe section 90 having a lower threaded end 94 and a lower drill pipe section 92 having an upper threaded end 96. The two drill pipe sections will be connected together by means of a threaded collar 18 having internal threads 20 in the same manner as described in relation to the previous embodiments. However, the comparison between the embodiment of FIG. 15 and that of FIG. 12 now comes to an end because the threaded portion 94, instead of being provided with three legs or extensions as shown in FIGS. 12 to 14 is provided with seven separate legs or extensions 130, 132, 134, 136, 138, 140 and 142 separated respectively by slots 144, 146, 148, 150, 152, 154 and 156 as shown in FIGS. 15 and 16. The legs which appear in front are 130 and 132 with portions of legs 134 and 142 appearing at the sides. The slots which appear in FIG. 15 are slots 144, 146 and 156. Turning now to the lower portion of FIG. 15 and to FIG. 17, the upper threaded portion 96 of the lower drill pipe section 92 is provided with seven upwardly projecting extensions or legs 160, 162, 164, 166, 168, 170 and 172. Starting with the space 174 which is provided between the vertical legs 160 and 162, the threaded upper end of the drill pipe section 92 is provided with vertical slots 174, 176, 178, 180, 182, 184 and 186. Referring again to the lower portion of FIG. 15, the legs which will appear visible are legs 160, 162 and 172 and the slots which will appear visible are slots 174 and 186.

With respect to the vertical legs shown in FIGS. 15, 16 and 17 it should be apparent that the individual vertical legs are essentially of the same circumferential extent except for the vertical leg 136 extending downwardly from the threaded end 94. The same considerations hold true for the slots; that is, all of the slots seem to have essentially the same circumferential extent except for the slot 178. When the upper drill pipe 90 is placed in nesting relation with the lower drill pipe 92, the wide vertical leg 136 will be received in the wide vertical slot 138; continuing on, the vertical legs 130 and 132, for example, will be received in the slots 186 and 174, respectively, in the threaded end 96. At the same time, the upwardly projecting legs 172, 160 and 162 will be received in the vertical slots 156, 144 and 146, respectively, of the threaded end 94 at the lower end of the upper drill pipe section 90. Again, since the only slot in the threaded portion 96 on the lower drill pipe section 92 which is capable of accommodating the leg 136 is the slot 178, there is one way and one way only in which the two drill pipe sections 90 and 92 can be nested together.

Figure 18:
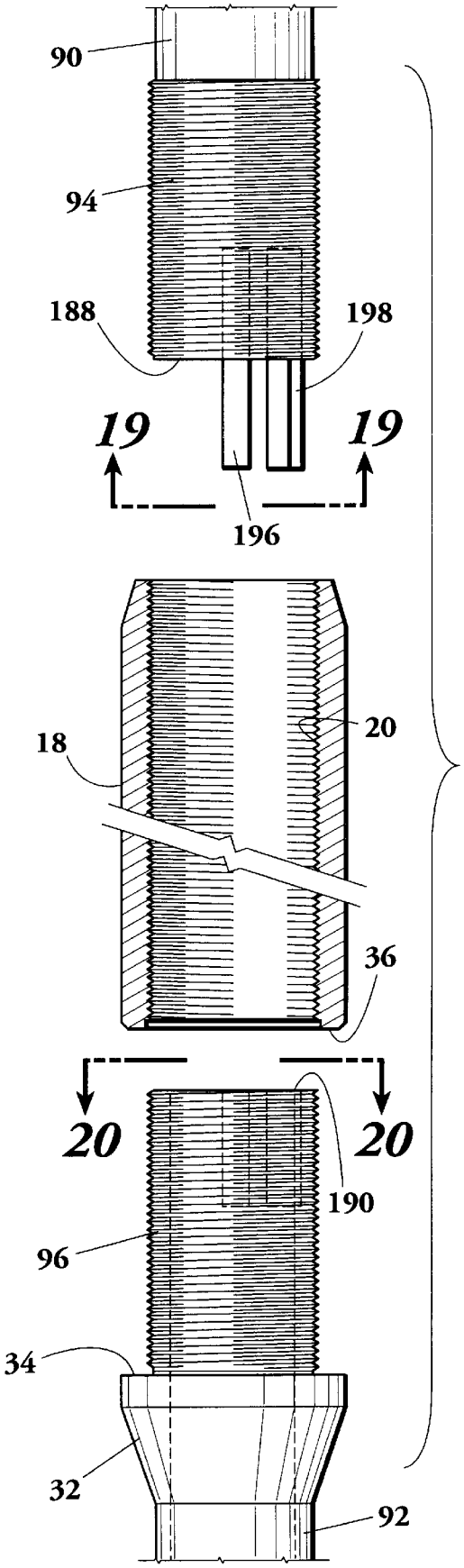
FIG. 18 is an exploded view similar to FIG. 1 but showing a further embodiment of the present invention.
Figure 19:
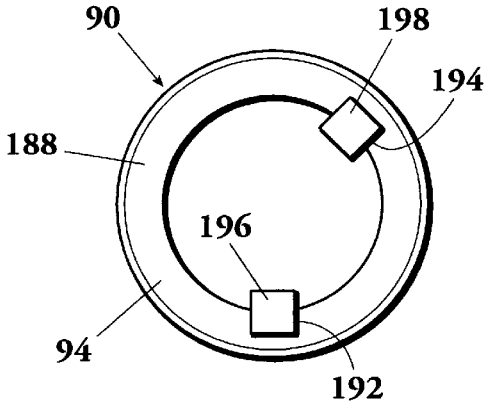
FIG. 19 is a bottom view of the upper drill pipe section shown in FIG. 18 looking along viewing line 19—19 of FIG. 18.
Figure 20:
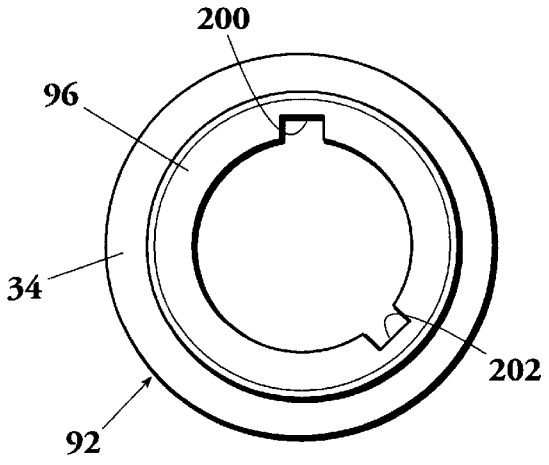
FIG. 20 is a top view of the lower drill pipe section shown in FIG. 18 looking along viewing line 20—20 of FIG. 18.

Turning now to consideration of FIGS. 18, 19 and 20, the two drill pipes shown in these figures are interconnected, not by means of legs or extensions which cooperate with recesses on the other pipe section, but by means of a plurality of keys and keyways which are asymmetrically arranged so as to permit but one mode of nesting. Referring to FIG. 18, more particularly, this figure shows an upper drill pipe section 90 having a lower threaded end 94, a lower drill pipe section 92 having an upper threaded portion 96, and a threaded collar 18 having an inner threaded portion 20. The collar is used, ultimately, to hold the two drill pipe sections 90 and 92 together as has been described previously. The threaded end 94 is not provided with downwardly extending legs or with a bevelled edge, etc. Actually a lower end 188 of the section of the threaded end 94 is flat and horizontal so as to mate with an upper end 190 at the upper end of the threaded end 96 when the two pipes 90 and 92 are placed in their proper nesting relation.

The lower end 94 of the pipe section 90 is provided with two vertically extending slots 192 and 194, the slot 192 being at the rear of the pipe section 90 as it appears in FIG. 18 and the slot 94 being placed 120° away from the first slot towards the front and the right. A pair of vertically extending bars or keys 196 and 198 are snugly received, by welding or the like, in the key slots 192 and 194, respectively. The lower ends of the keys 196 and 198 project downwardly below the lower end 188 of the threaded pipe end 94. The threaded end 96 of the lower pipe section 92 is also provided with a pair of complementary slots 200 and 202 which extend vertically along the inner side of the pipe section 92. The vertical dimension or depth of the key slots 200 and 202 should be equal to or slightly greater than the amount by which the keys 196 and 198 extend downwardly below the lower end 198 of the threaded end 194. When the upper pipe section 90 is lowered down toward the lower pipe section 92, the keys 196 and 198 will be received in the lower slots or keyways 200 and 202, respectively, thereafter when the lower end 188 of the threaded end 94 abuts the upper end 90 of the threaded end 96. The collar 18 can be turned until its lower end 36 comes to rest against the shoulder 34 of the flange 32.

Whereas the embodiment shown in FIGS. 18 and 20 represents two keys on one pipe section cooperating with two keyways on the other pipe section, obviously a single key and key slot could be used. Also, a plurality of keys could be employed providing they are arranged in an asymmetrical relation such that the two pipe sections 90 and 92 can be put together in one and only one way.

Figure 21:
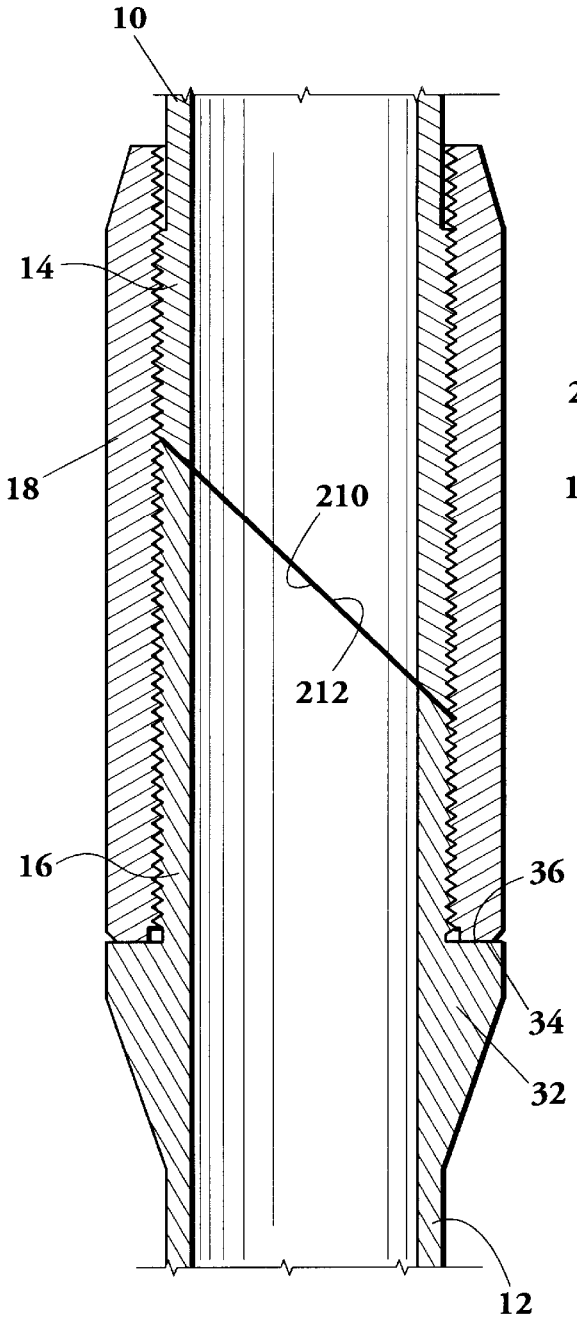
FIG. 21 is a view similar to FIG. 5 but showing yet another embodiment of the present invention.

FIG. 21 shows, in cross-section, an embodiment which is similar to that shown and described in relation to FIG. 5; that is, this view shows an upper pipe section 10 having a lower threaded portion 14 and a lower pipe section 12 having an upper threaded portion 16. The lower pipe section is provided with a flange 32 having a shoulder 34 and a threaded collar 18 is shown as threaded all the way on to both pipe sections 10 and 12 with the lower end 36 of the collar 18 seating on the shoulder 34. However, the shape of the lower end of the upper pipe section 10 and the shape of the upper end of the lower pipe section 12 are different from any of the prior figures. To be more specific, the lower end of the threaded section 14 of the upper pipe section 10 is sliced off at an angle so as to provide an inclined surface 210. Similarly, the upper end the threaded section 16 of the lower pipe section 12 is sliced off at an angle so as to provide an inclined surface 212. When the pipe sections 10 and 12 are brought into abutting relation, as shown in FIG. 21, the inclined surface 210 will lie against the inclined surface 212. Again, these two pipe sections 10 and 12 can mate in one and only one way.

Figure 22:
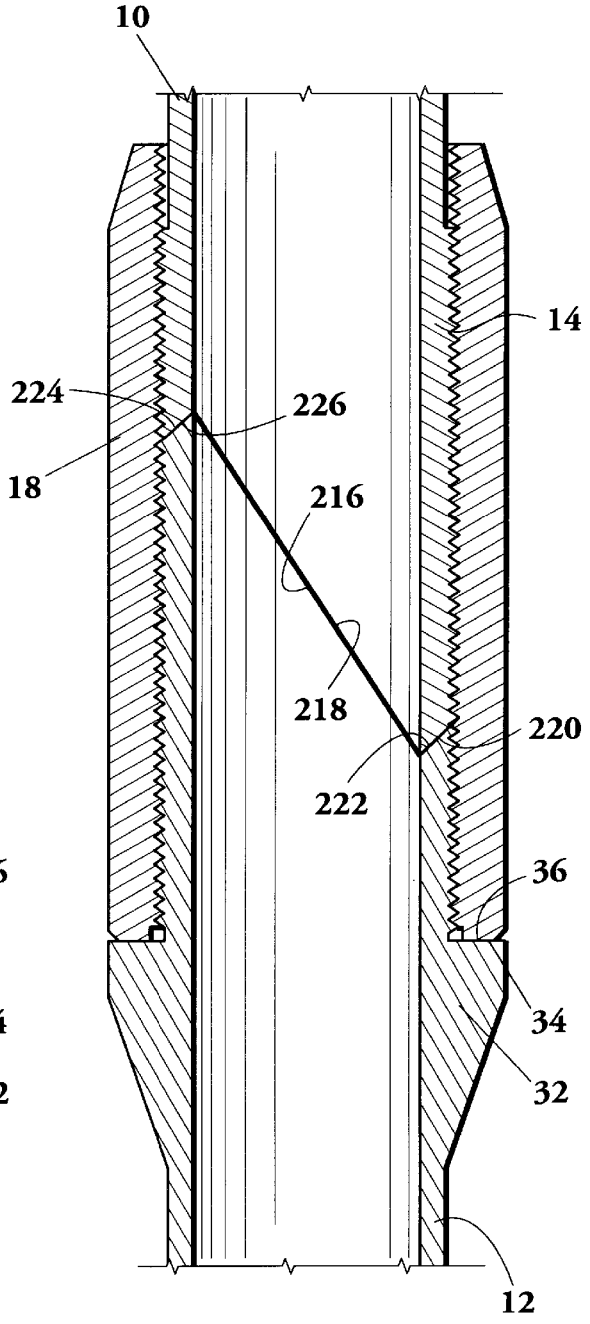
FIG. 22 is a view also similar to FIG. 5 but showing a still further embodiment of the present invention.

FIG. 22 is a view, in cross section, which is similar in many respects to FIG. 21. However, the differences will be described as follows. FIG. 22, as was the case with FIG. 21, is provided with an upper pipe section 10 and a lower pipe section 12, the latter having a flange 32 with a shoulder 34. The two pipe sections are held together by means of a collar 18 which engages a lower threaded end 14 on the pipe section 10 and an upper threaded end 16 on the lower pipe section 12. The mating portions of the pipe sections 10 and 12, in the area from one side of the inner wall to the opposite side of the inner wall, are cut at an angle, as in the case of FIG. 21, such that the upper pipe section 10 is provided with an inclined surface 216 which mates with an inclined surface 218 on the upper end of the lower pipe section 12. However, across the thickness of the pipes the inclination is in the opposite direction with respect to the surfaces 216 and 218. That is, the lower right-hand end of the threaded section 14 is provided with a beveled surface 220 and the upper end of the right-hand portion of the threaded end 16 is provided with a complimentarily shaped inclined surface 222. The surface 220 merges with the surface 216 and the surface 222 merges with the surface 218. At the upper left-hand end of the threaded portion 16, the pipe section 12 is provided with a bevel 224 which mates with an internal bevel 226 at the lower end on the left-hand side of the threaded portion 14. Thus, when the two pipe sections 10 and 12 are placed in abutting relation, as shown in FIG. 22, the lower right-hand end of the threaded portion 14 will be tucked in against the upper right-hand end of the threaded portion 16 while the upper left-hand end of the threaded portion 16 will be tucked in against the lower left-hand end of the threaded portion 14.

Figure 23:
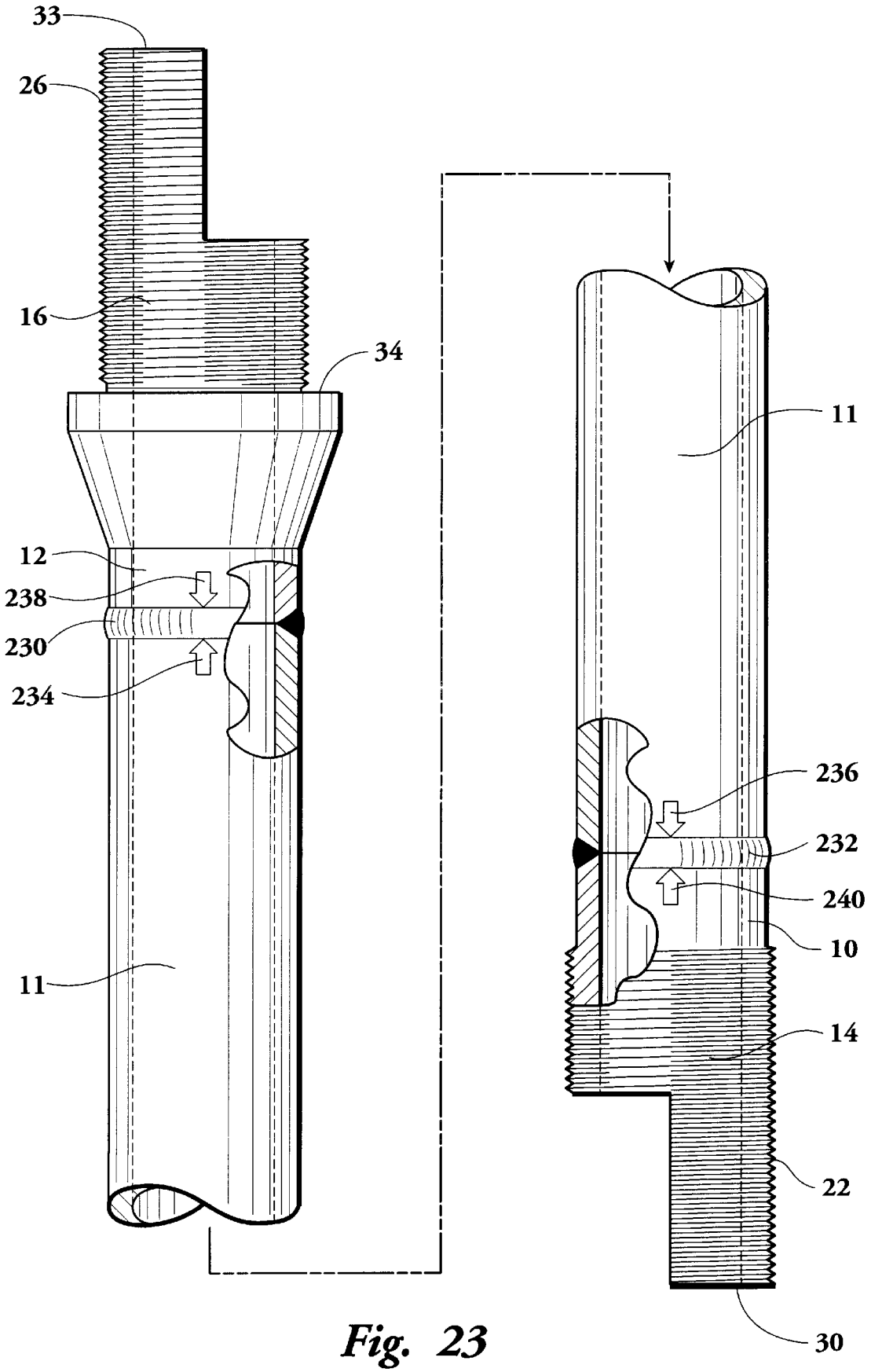
FIG. 23 is a broken view showing a drill pipe tube which is also broken and illustrating one method of attaching the shaped joint ends of the present invention to the ends of the drill pipe 2.

FIG. 23 shows a drill pipe tube 11 to which the shaped portions of the drill pipe sections are welded, as will appear hereinafter. Before describing FIG. 23 in any further detail, it should be understood, as referenced earlier, that the drill pipe sections 10 and 12, shown in FIG. 1 for example, would be machined separately at each end. However, since drill pipe sections are generally 30' in length or more and since the threaded end 14 has threads thereon which project beyond the outer diameter of the drill pipe section 10 above the threaded portion 14 (as shown in FIG. 1), it is not easy to machine a total drill pipe section so as to provide shapes and threads at the opposite ends. In fact, it is common practice in the industry to take a drill pipe tube, such as tube 11 and attach the "joint" ends to the ends of the drill pipe tube by welding, for example. Thus, with respect to the embodiment shown in FIGS. 1 to 5, a person manufacturing "pipe joints" would make a section 10 having a vertical length from the broken line at the top of FIG. 1 to the bottom line 30; the same person would also make a complimentary section 12 which would have a length represented by the distance from the end 33 to the broken line at the bottom of FIG. 1. This same person would also manufacture the collar 18 shown in FIG. 1. The collar 18 is not shown in FIG. 23 for purposes of simplicity; however, prior to utilizing the tube shown in FIG. 23, the collar 18 would be mounted on the lower end of the tube 11 above the lower threaded end 14. The lower end of the section 12 would be connected to the upper end of the pipe tube 11 by means of welding 230, for example, whereas the upper end of the section 10 would be connected to the lower end of the tube 11 by means of welding 232, for example.

In order to ensure that the section 10 is aligned with the section 12, the drill pipe tube 11 is provided with markings 234 and 236 at the top and bottom, respectively, of the tube 11. If desired, the marks 234 and 236 could be represented by a single vertical line which extends for the full length of the tube 11; however, it is only necessary that these alignment marks 234 and 236 appear at the ends of the tube 11. On the other hand, it is essential that the marks 234 and 236 on each tube 11 be in vertical alignment with each other. These marks 234 and 236 can be in any convenient form or color, but are shown on FIG. 23 simply as arrows. The upper section 12 is also provided with an alignment mark 238 which is similar to the marks 234 and 236. When placing the section 12 against the top of the tube 11, the mark 238 is aligned with the mark 234 prior to creating the weld joint 230. Similarly, the lower section 10 is provided with a mark 240 which is similar to the mark 238. Prior to welding the end 10 to the lower end of the pipe tube 11, the marks 240 and 236 are aligned with each other and the welding 232 is thereafter applied.

Further with respect to FIG. 23, this represents the utilization of a pipe tube 11 with the embodiment of pipe joint ends as shown in FIGS. 1 to 5. It should be understood that the technique of FIG. 23 is also applied to the embodiments shown in FIGS. 6 to 8, FIGS. 9 to 11, FIGS. 12 to 14, FIGS. 15 to 17, FIGS. 18 to 20, FIG. 21 and FIG. 22. Referring to FIGS. 6 to 8, inclusive, the embodiment shown therein would be prepared as a complete pipe joint, for example, by making the upper portion 50 with a length represented by the broken line at the top of FIG. 6 and extending down to the inclined surface 70, a separate section 52 having a length represented by the inclined upper end 72 down to the broken line at the bottom of FIG. 6 and a collar such as collar 18. Thereafter, the section 50 would be welded to the lower end of a pipe tube 11 in the same manner that portion 10 was welded to the lower end of tube 11. Likewise, the section 52 would be welded to the upper end of a tube 11 in the same manner that section 12 was welded to the upper end of the tube 11 as shown in FIG. 23.

Whereas the embodiment shown in FIGS. 12 through 14 shows three extensions on one pipe section mating with three recesses on the other pipe section and whereas the embodiment shown in FIGS. 15 to 17 shows seven extensions on one pipe section mating with seven recesses on the other pipe section, obviously the intermating pipe sections could be provided with a greater number of projections cooperating with a corresponding number of recesses; this would be so, providing the pipe sections could be combined in one way and one way only. For example, a connection could be provided similar to a radio tube socket where one of the prongs was missing and a corresponding recess on the other member was also missing. This would result in an arrangement where the two sections could be combined together in one way only.

Whereas the description heretofore has set forth the invention principally in terms of its application to drill pipe, and whereas the drawings are typical of structure which would be more recognizable as drill pipe, it should be understood that the present invention has equal applicability to tubing. In this regard "tubing" exists in sections and is connected together to form a tubing string which is similar in many respects to a drill string. The similarities between drill pipe and tubing (which is used in connection with drill pipe) is well recognized. Typical drill pipe sizes range from ⅜" OD to 6⅝" OD. Typically drill pipe sections are 30' to 34' in length.

Tubing on the other hand is generally smaller in diameter, smaller in wall thickness and frequently made of material which makes tubing much lighter and easier to handle. Typical tubing sizes are 2⅜" OD, 2⅞" OD, and sometimes 3½" OD with wall thicknesses varying from ¼" to ⅜". The tubing sections are also 30' in length.

The tubing sections are generally sufficiently light and sufficiently easy to handle that they can be machined at their ends without requiring application of sections as in the case of drill pipe, such as illustrated in FIG. 23 and explained in the specification above in relation to the description of FIG. 23. On the other hand, for the purpose of the present invention, when applying the same to tubing it would appear to be preferable to provide the joint approach to adapting the ends of the tubing to the present invention; that is, separate tubing portions corresponding to items 10 and 12 in FIG. 1 would be properly conformed in accordance with the present invention and attached to opposite ends of a tubing section similar to tube 11, being sure, however, that proper alignment of the ends is achieved by arrows similar to arrows Occasionally it is necessary to employ tools, such as perforating guns, at the lower end of a tubing string. It may be important to know the direction in which the perforating gun is pointing when using a fracturing process. The similarities between tubing and drill pipe are too well know to require a separate illustration of the application of the present invention to tubing. The same considerations hold true for "casing" which, obviously, is nothing more than larger diameter tubing.

As to the specific description set forth herein which emphasizes the invention more particularly in relation to drill pipe, the man skilled in this art would understand how the invention shown in the various FIGS. 1 to 23 can be equally applied to what is commonly referred to as "tubing" or "casing".

Accordingly, in the following claims it should be understood that the term "drill pipe" should be considered as including "tubing" and "casing"; also the term "drill string" should also be considered as including "tubing string" and "casing string".

What is claimed is:

1. In a drill string of the type comprising a plurality of drill pipe sections arranged in end to end relation from a location above the ground to a lower location adjacent an oreientable tool connected to a bottom end of the drill string and wherein the adjacent ends of the drill pipe sections are connected to each other to form a plurality of spaced pipe joints extending downwardly from the ground to the tool, the improvement which comprises manufacturing the drill string so that the same is in alignment from the top to the bottom thereof and wherein each pipe section is provided with a lower end having a downwardly projecting extension and an upper end having a complementary recess which is in alignment with and corresponds with the downwardly projecting extension on the lower end of the same pipe section, and wherein each pipe joint comprises an upper drill pipe section having its downwardly projecting extension received in the corresponding recess in the next adjacent lower drill pipe section and wherein the extensions and the recesses can fit together in only one way, wherein the adjacent ends of the sections are threaded and wherein an internally threaded collar is received over the threaded ends to hold the sections of each pipe joint securely together.

2. A drill pipe joint as set forth in claim 1 wherein the downwardly projecting extension on the upper drill pipe section at each pipe joint is a semi-annular extension and the recess on the lower drill pipe section at the same pipe joint is a semi-annular recess, the lower drill pipe section having a semi-annular extension which extends upwardly to mate with a semi-annular recess on the lower end of the upper drill pipe section, the downwardly extending semi-annular portion of the upper drill pipe section being provided with a lower shoulder which mates against a shoulder at the bottom of the recess on the lower drill pipe section, the upper end of the semi-annular extension on the lower drill pipe section being provided with a shoulder which mates with a shoulder at the upper end of the recess on the upper drill pipe section.

3. A drill pipe joint as set forth in claim 2 wherein all the shoulders are parallel to a plane which is inclined with respect to the longitudinal centerline of the drill string.

4. A drill pipe joint as set forth in claim 2 wherein the shoulders are flat and wherein the intermating shoulders are provided with conical pins on the shoulders of one drill pipe joint which mate with conical recesses on the shoulders of the other drill pipe section.

5. A drill pipe joint as set forth in claim 1 wherein the upper drill pipe section and lower drill pipe section are provided with keyways which are asymmetrically related with respect to the longitudinal axis of the drill string and wherein keys are affixed to the keyways of the upper drill section and are adapted to fit into the keyways of the lower drill pipe section.

6. A drill pipe joint as set forth in claim 1 wherein the upper drill pipe section is provided with at least three downwardly extending legs which are asymmetrically arranged with respect to the longitudinal axis of the drill string and wherein the lower drill pipe section is provided with a corresponding number of recesses arranged so as to receive with the legs of the upper drill pipe section.

7. In a drill string of the type comprising a plurality of drill pipe sections arranged in end to end relation from a location above the ground to a lower location adjacent a tool connected to a bottom end of the drill string and wherein the adjacent ends of the drill pipe sections are connected to each other to form a plurality of spaced pipe joints extending downwardly from the ground to the tool, the method of manufacturing the drill string so that the same is in alignment from the top to the bottom thereof, the method comprising shaping the lower end of each pipe section, except for the lowermost section in the drill string, in a first predetermined shape, shaping the upper end of each pipe section, except for the uppermost section in the drill string, in a second predetermined shape which is complementary and aligned to the first predetermined shape, whereby each pipe joint is formed by connecting the lower end of an upper pipe section with the upper end of a lower pipe section, so that they fit together in only one way when said upper drill pipe section is placed in abutting relation with said lower drill pipe section.

8. A method as set forth in claim 7 wherein the lower end of each drill pipe section is shaped by providing at least one downwardly projecting extension and wherein the upper end of each drill pipe section is shaped by providing a corresponding recess for receiving the extension such that the extension and recess can fit together in only one way.

9. A method as set forth in claim 8 wherein the extension is a semi-annular extension and wherein the recess is a semi-annular recess.

10. A method as set forth in claim 7 wherein the lower end of said drill pipe section is shaped so as to provide a plurality of downwardly extending legs which are asymmetrically arranged with respect to the longitudinal axis of the drill string and wherein the upper end of said drill pipe section is shaped to provide a corresponding number of recesses arranged to receive an adjacent legs of the upper drill pipe section.

11. In a drill string of the type comprising a plurality of drill pipe sections arranged in end-to-end relation from a location above the ground to a lower location adjacent a drill bit connected to the bottom end of the drill string and wherein the adjacent ends of the drill pipe sections are connected to each other to form a plurality of spaced pipe joints extending downwardly from the ground to the drill bit, the method of assembling all of the drill pipe sections successively with each other in aligned relationship which comprises constructing each drill pipe section from a tube, welding a shaped portion to the upper end of each tube, welding a complimentarily shaped portion to the lower end of each tube, each tube with the welded ends thereon thus constituting a drill pipe section, the upper and lower ends of each drill pipe section being aligned with each other so that when a given drill pipe section is placed in abutting relation with the next lowerdrill pipe section they will fit together in only one way.

* * * * *